US009464533B2

(12) United States Patent
Landi et al.

(10) Patent No.: US 9,464,533 B2
(45) Date of Patent: Oct. 11, 2016

(54) COMPACT IGV FOR TURBOEXPANDER APPLICATION

(75) Inventors: Giacomo Landi, Florence (IT); Antonio Asti, Florence (IT); Paolo Del Turco, Florence (IT)

(73) Assignee: Nuovo Pignone S.p.A, Florence (IT)

( * ) Notice: Subject to any disclaimer, the term of this patent is extended or adjusted under 35 U.S.C. 154(b) by 791 days.

(21) Appl. No.: 13/600,989

(22) Filed: Aug. 31, 2012

(65) Prior Publication Data

US 2013/0236295 A1 Sep. 12, 2013

(30) Foreign Application Priority Data

Aug. 31, 2011 (IT) ..... CO2011A0034

(51) Int. Cl.

| | |
|---|---|
| ***F01D 9/04*** | (2006.01) |
| ***F01D 17/16*** | (2006.01) |
| ***F04D 29/46*** | (2006.01) |
| ***F04D 29/42*** | (2006.01) |

(52) U.S. Cl.

CPC ..... *F01D 9/04* (2013.01); *F01D 17/165* (2013.01); *F04D 29/4213* (2013.01); *F04D 29/462* (2013.01); *F05D 2220/40* (2013.01); *F05D 2230/64* (2013.01); *F05D 2250/51* (2013.01); *F05D 2260/50* (2013.01); *Y10T 29/49321* (2015.01)

(58) Field of Classification Search

CPC ..... F01D 1/06; F01D 9/04; F01D 9/041; F01D 9/045; F01D 17/16; F01D 17/165; F01D 17/00; F01D 17/10; F01D 17/12; F01D 17/14; F05D 2250/51; F05D 2260/50; F05D 2220/40; F05D 2230/64; Y10T 29/49321

See application file for complete search history.

(56) References Cited

U.S. PATENT DOCUMENTS

| | | | | |
|---|---|---|---|---|
| 2,862,654 | A * | 12/1958 | Gardiner | 415/161 |
| 3,495,921 | A | 2/1970 | Swearingen | |
| 4,242,040 | A | 12/1980 | Swearingen | |

(Continued)

FOREIGN PATENT DOCUMENTS

| | | | |
|---|---|---|---|
| CN | 101384796 | A | 3/2009 |
| CN | 101876260 | A | 11/2010 |
| DE | 19717855 | A1 | 11/1998 |
| DE | 10224051 | A1 | 12/2003 |
| DE | 10238412 | A1 | 3/2004 |
| DE | 102006053332 | A1 | 5/2008 |

(Continued)

OTHER PUBLICATIONS

Unofficial English Translation of Chinese Office Action issued in connection with corresponding CN Application No. 201210317556.4 on Feb. 4, 2015.

(Continued)

*Primary Examiner* — Christopher Verdier
*Assistant Examiner* — Adam W Brown
(74) *Attorney, Agent, or Firm* — GE Global Patent Operation

(57) ABSTRACT

An inlet guide vane actuation apparatus is provided. The inlet guide vane actuation apparatus comprises an actuation ring with a first connector for connecting an actuator rod, wherein the first connector positions the actuator rod over the rotational axial center of the actuation ring, a plurality of crank rods with a first end connected respectively to a plurality of second connectors located on the rotational axial center of the actuation ring; and a plurality of cranks with each having a third connector connected respectively to a second end of the plurality of crank rods and respectively to vanes associated with a nozzle, wherein the third connector located on the rotational axial center of the actuation ring.

20 Claims, 4 Drawing Sheets

(56) References Cited

U.S. PATENT DOCUMENTS

| | | | | |
|---|---|---|---|---|
| 4,502,836 | A | 3/1985 | Swearingen | |
| 4,890,977 | A * | 1/1990 | Tremaine et al. | 415/164 |
| 4,978,279 | A | 12/1990 | Rodgers | |
| 5,136,854 | A | 8/1992 | Abdelmalek | |
| 5,564,895 | A | 10/1996 | Ahahi et al. | |
| 5,851,104 | A | 12/1998 | Dakin et al. | |
| 6,672,826 | B2 | 1/2004 | LeDuc | |
| 8,186,944 | B2 | 5/2012 | Tries et al. | |
| 8,231,326 | B2 | 7/2012 | Mariotti et al. | |
| 8,944,747 | B2 * | 2/2015 | Sarri et al. | 415/1 |
| 2003/0190229 | A1 | 10/2003 | LeDuc | |
| 2006/0096287 | A1 | 5/2006 | Sumser et al. | |
| 2007/0166149 | A1 | 7/2007 | Tacconelli et al. | |
| 2008/0092538 | A1 | 4/2008 | Fledersbacher et al. | |
| 2010/0247287 | A1 * | 9/2010 | Mariotti et al. | 415/1 |

FOREIGN PATENT DOCUMENTS

| | | | |
|---|---|---|---|
| EP | 1357255 | A1 | 10/2003 |
| EP | 1391584 | A2 | 2/2004 |
| EP | 1635040 | A1 | 3/2006 |
| EP | 1635041 | A1 | 3/2006 |
| WO | 9931356 | A1 | 6/1999 |
| WO | 2008049818 | A2 | 5/2008 |

OTHER PUBLICATIONS

Search Report and Written Opinion issued in connection with corresponding IT Application No. CO2011000034 dated Apr. 13, 2012.

European Search Report and Written Opinion issued in connection with corresponding EP Application No. 12181785.2-1607 dated Apr. 7, 2015.

* cited by examiner

COMPACT IGV FOR TURBOEXPANDER APPLICATION

BACKGROUND OF THE INVENTION

Embodiments of the invention relate to methods and devices and, more particularly, to mechanisms and techniques for more precisely controlling, with less applied force, inlet guide vanes of turbo-machinery.

Turbo-machinery generally has internal rotating components, typically inlet guide vanes (IGV) for example, which are adjusted based on the operating conditions of the turbo-machinery. In an automated system, adjusting the inlet guide vanes requires the use of an actuator attached to an actuator rod connected to an actuator ring operating a four bar mechanism or a slotted nozzle driven in rotation by fixed pins on the actuation ring. In available inlet guide vane solutions, as shown prior art FIG. 1, the inlet guide vane's control components for adjusting the vanes are positioned in different parallel planes. For example, looking to FIG. 1, the four bar mechanism 108 is on a plane between the plane of the vanes 106 and the plane of actuation ring 104 where the actuator rod connects to a pin 102 on the actuation ring 104. In another example, prior art FIG. 2 depicts a slotted nozzle driven inlet guide vane assembly with the actuator 208, the actuation ring 204 and the levers operating the vanes 206 in different planes.

The currently available designs result in several problems experienced during operation. With regard to the four bar system, the force applied to the actuate the vanes is in a different plane than the actuator ring and the four bar mechanism and is therefore non-symmetrically applied with respect to the bushings and connection points between the actuation rod, actuation ring and the four bar mechanism. Accordingly, a bending force is exerted on the actuation rod increasing the force necessary to rotate the actuation ring and stickling of the connection components. Similarly, the slotted nozzle system as illustrated in FIG. 2, develops guide ring fretting leading to increased actuation force requirements, jamming and gain hunting. For both mechanisms, a desirable characteristic would also include a more compact design of the inlet guide vane system leading to both a reduction in mass and a reduction in the force necessary to operate the inlet guide vane system. A detailed description of the construction and operation of a prior art inlet guide vane system is presented in U.S. patent application Ser. No. 12/415,417 incorporated herein by reference.

Accordingly, it would be desirable to provide devices and methods that avoid the afore-described problems and drawbacks.

BRIEF DESCRIPTION OF THE INVENTION

According to an embodiment of the present invention, an inlet guide vane actuation apparatus is provided. The inlet guide vane actuation apparatus comprises: an actuation ring with a first connector for connecting an actuator rod, wherein the first connector positions the actuator rod over the rotational axial center of the actuation ring; a plurality of crank rods with a first end connected respectively to a plurality of second connectors located on the rotational axial center of the actuation ring; and a plurality of cranks with each having a third connector connected respectively to a second end of the plurality of crank rods and respectively to vanes associated with a nozzle, wherein the third connector is located on the rotational axial center of the actuation ring.

According to another embodiment of the present invention, a turbo-machine is provided. The turbo-machine comprises: a casing for enclosing the turbo-machine component a plurality of rotors mounted on a rotating shaft associated with the casing; a plurality of stators mounted in the casing; an inlet connection allowing entry of a working fluid; an outlet connection allowing exit of the working fluid; and an inlet guide vane actuation apparatus comprising: an actuation ring with a first connector for connecting an actuator rod, wherein the first connector positions the actuator rod over the rotational axial center of the actuation ring; a plurality of crank rods with a first end connected respectively to a plurality of second connectors located on the rotational axial center of the actuation ring; and a plurality of cranks with each having a third connector connected respectively to a second end of the plurality of crank rods and respectively to vanes associated with a nozzle, wherein the third connector is located on the rotational axial center of the actuation ring.

According to another embodiment of the present invention, a method for manufacturing an inlet guide vane system associated with turbo-machinery is provided. The method comprises: connecting a first end of an actuator rod to an actuation ring associated with the turbo-machinery, wherein the actuator rod is centered over the rotational axial center of the actuation ring; connecting a first end of each of a plurality of crank rods respectively to a plurality of connectors on the actuation ring wherein the plurality of crank rods are centered over the rotational axial center of the actuation ring, wherein the plurality of crank rods are centered over the rotational axial center of the actuation ring; and connecting a plurality of cranks respectively to a second end of each of the plurality of crank rods and respectively to a plurality of vanes associated with the turbo-machinery, wherein the plurality of cranks are centered over the rotational axial center of the actuation ring.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION OF THE EXEMPLARY EMBODIMENTS OF THE INVENTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of turbo-machinery including but not limited to compressors and expanders. Turbo-machinery typically comprises a casing, a rotating shall, rotors attached to the rotating shaft stators attached to the casing, a connection to allow to working fluid to enter the turbo-machinery and a connection to allow the working fluid to exit the turbo-machinery.

Reference throughout the specification to "one embodiment" or an "embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in on more embodiments.

Figure 1:
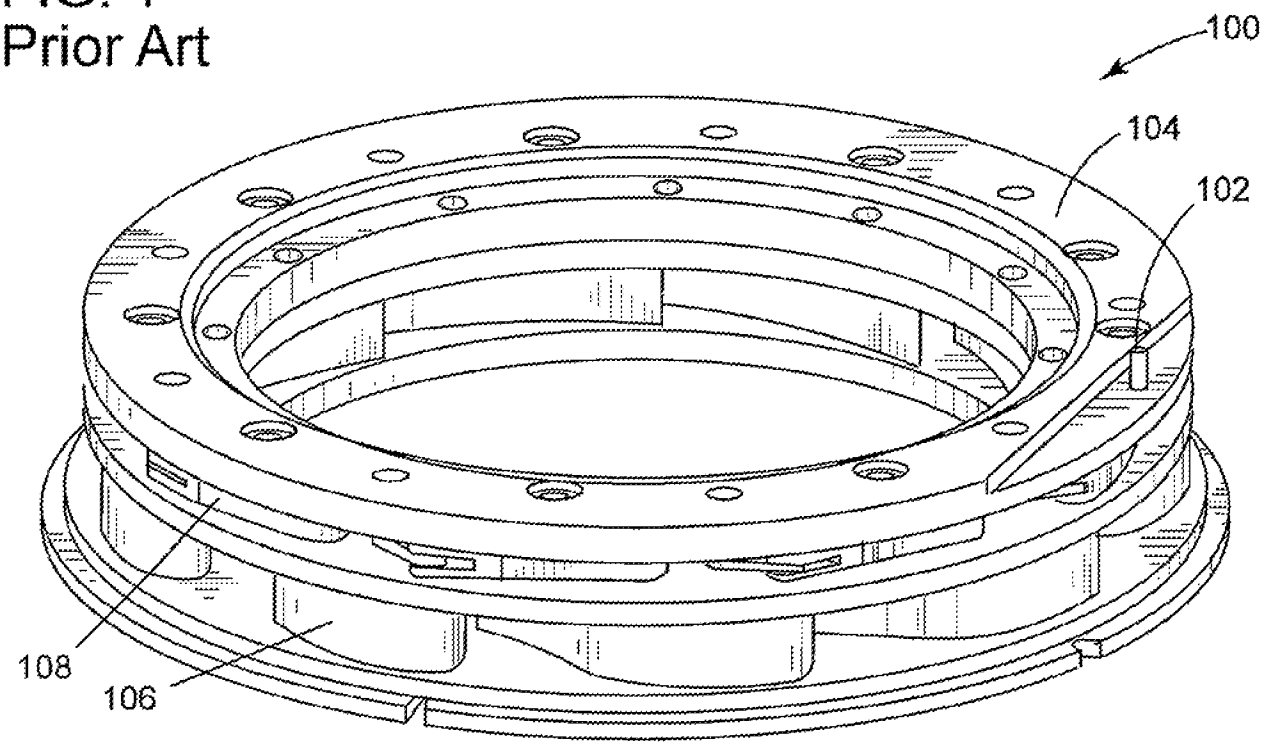
FIG. 1 Prior Art
FIG. 1 is a prior art embodiment of a four bar inlet guide vane system for turbo-machinery with operational components in different planes.
Figure 2:
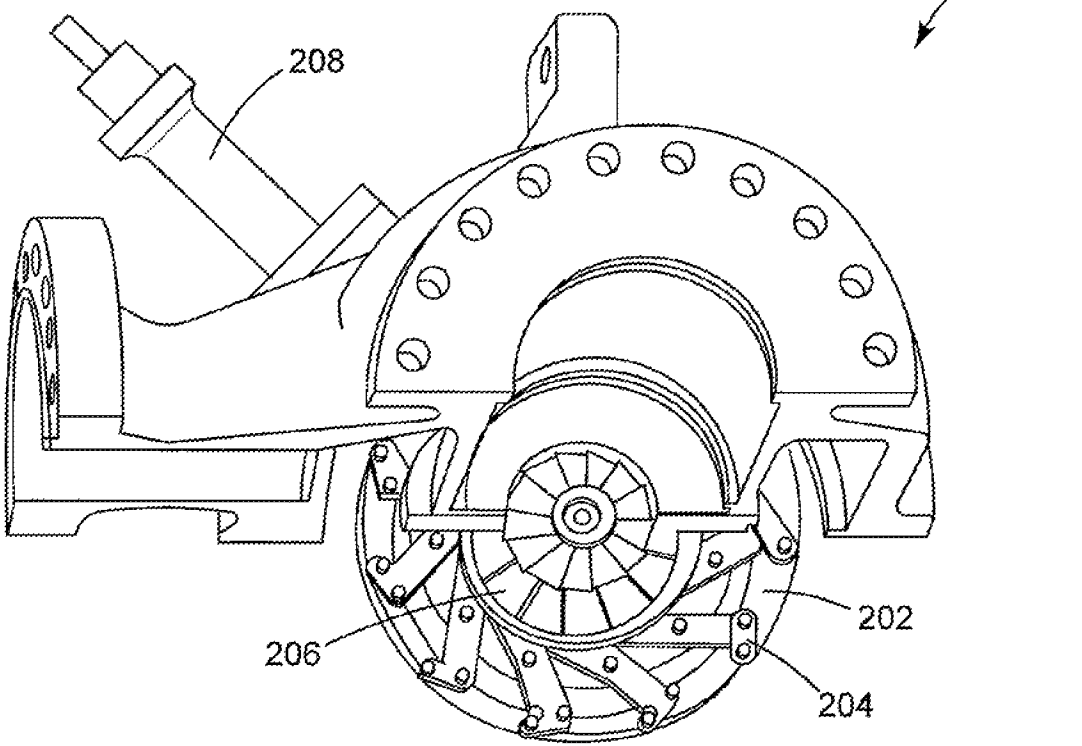
FIG. 2 Prior Art
FIG. 2 is a prior art embodiment of a slotted nozzle inlet guide vane system for turbo-machinery with operational components in different planes.
Figure 3:
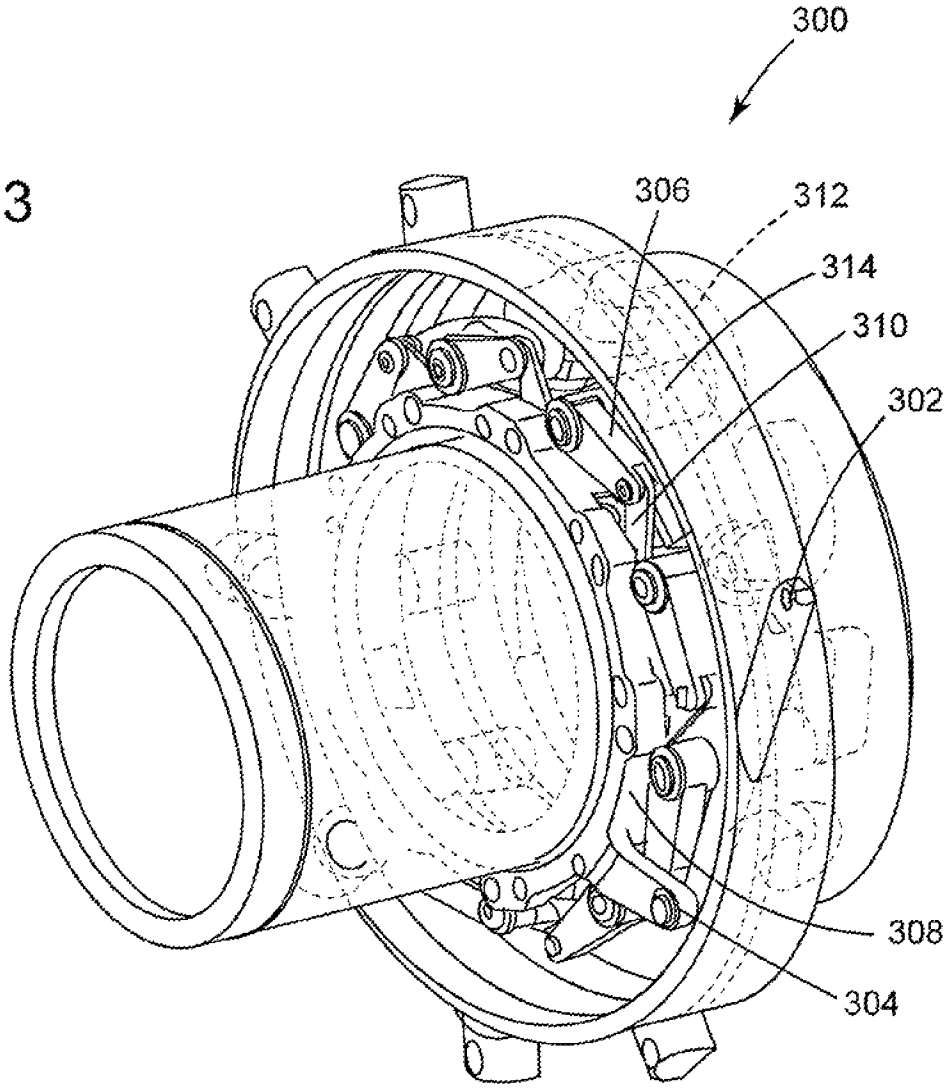
FIG. 3 is an exemplary embodiment of a compact single-plane inlet guide vane system for turbo-machinery with operational components in the same plane.

FIG. 3 depicts an exemplary embodiment of a compact inlet guide vane system 300. In an aspect of the exemplary embodiment, the actuation rod 302 is connected to the actuation ring 308 at the center point of the actuation ring 308 with respect to the axial width of the actuation ring 308. Two brackets 304 extend outwards in a radial direction from the actuation ring 308. There is one bracket 304 at each edge of the actuation ring 308 providing space between the brackets 304 for connecting the actuation rod disposed in a position centered on the actuation ring. A pin is secured through a hole in the actuation rod 302 and in each bracket 304 allowing the actuation rod 302 to rotate with respect to the brackets 304.

As the actuation rod 302 is moved by the actuator, a force, centered on the actuation ring 308, is applied by the actuation rod 302 to the actuation ring 308 and the actuation ring 308 rotates either clockwise or counterclockwise based on the direction of the movement of the actuation rod 302. In another aspect of the exemplary embodiment, the rotation of the actuation ring 308 moves crank rods 310 that are connected to the actuation ring 308 on one end and to a representative crank 306 on the other end in an embodiment, the representative crank rod 310, like the actuation rod 302, is centered on the actuation ring 308 with respect to the axial width of the actuation ring 308.

Furthermore, the crank 306 has a connection point for the rod 310 similar in design as previously described for the actuation ring 308 connection point for the actuation rod 302, wherein the force exerted by the actuation ring 308 on the crank rod 310 and the crank rod 310 on the crank 306 is in the axial center plane of the actuation ring 308. In turn, the crank 306 is connected through a representative spline joint 314 to a representative nozzle vane 312 and as the crank 306 rotates, the nozzle vane 312 is adjusted to a desired position in the fluid path.

Accordingly, the exemplary embodiment describes applying force to an actuation rod 302 and transferring this force through different control and leverage mechanisms all located in the same axial plane at the axial center of the actuation ring 308 culminating in a rotational force adjusting the nozzle vanes 312 to a desired position. Based on the single axial plane force application design, a smaller force is required to generate the desired motion in the nozzle vanes 312 and the chance of the nozzle vanes sticking, is reduced because the bending force on the connection points and their bushings associated with transferring the applied force across a mechanism distributed through multiple axial planes has been eliminated.

Figure 4:
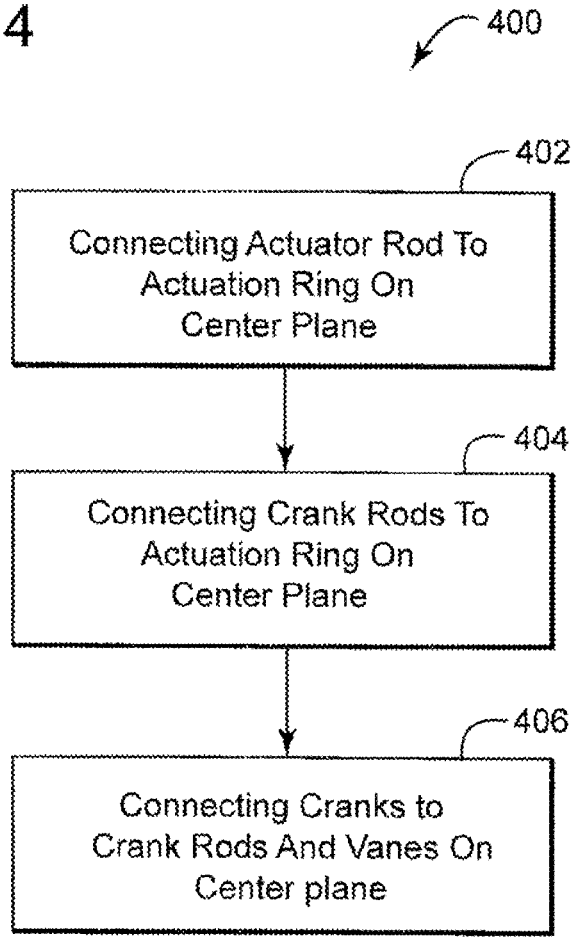
FIG. 4 is a flow chart illustrating operation of a single-plane inlet guide vane system integrated with turbo-machinery according to an exemplary embodiment of the present invention.

According to another embodiment of the present invention, a method for manufacturing an inlet guide vane system is provided. FIG. 4 illustrates a method for connecting the components of an inlet guide vane system. For example, frictional and binding losses associated with the connection points are reduced and, in addition, control accuracy may be improved as misalignment of the actuation rod can be avoided. The exemplary method includes a step 402 of connecting an actuator rod 302 to an actuation ring 308. In one aspect of the exemplary method, the actuation ring 308 has a connection point allowing the connection of the actuator rod 302 between two symmetrically formed brackets 304. A pin and bushing system is inserted through one bracket 304, the actuator rod 302 and then the other bracket 304. In another aspect of the exemplary method, the mounting position presented by the symmetrical brackets 304 locates the actuator rod 302 in a plane corresponding to the rotational axial center of the actuation ring 308.

Next at step 404 of the exemplary method one end of each of a plurality of crank rods 310 are connected respectively to connectors on the actuation ring 308. It should be noted in the exemplary method that the crank rods 310 can rotate around the connection point as the actuation ring 308 rotates. In another aspect of the exemplary method, the mounting position presented by the connection points on the actuation ring 308 locates the crank rods 310 in a plane corresponding to the rotational axial center of the actuation ring 308.

Continuing with step 406 of the exemplary method a plurality of cranks 306 are connected respectively to a second end of the plurality of crank rods 310. It should be noted in the exemplary method that the crank rods 310 can rotate around the connection point on the respective cranks as the actuation ring 308 rotates. In another aspect of the exemplary method, the plurality of cranks 306 are also connected respectively to a plurality of vanes 312 associated with a turbo-machine. In a further aspect of the exemplary method, the mounting position presented by the connection points on the crank rods locates the cranks 306 in a plane corresponding to the rotational axial center of the actuation ring 308.

The disclosed exemplary embodiments provide a device and a method for integrating an actuator into turbo-machinery and operating the actuator based on a process fluid pressure gradient across the turbo-machinery. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples to disclose the invention, including the best mode, and also to enable any person skilled in the art to practice the invention, including making and using any devices or systems and performing; any incorporated methods. The patentable scope of the invention is defined by the claims, and may include other examples that occur to those skilled in the art. Such other examples are intended to be within the scope of the claims if they have structural elements that do not differ from the literal language of the claims if they include equivalent structural elements to those recited in the literal languages of the claims.

What is claimed is:

1. An inlet guide vane actuation apparatus, comprising:

an actuation ring with a first connector for connecting an actuator rod, wherein the first connector positions the actuator rod outwards of the actuation ring in a plane corresponding to a center of an axial width of the actuation ring;

a plurality of crank rods with a first end connected respectively to a plurality of second connectors, wherein the plurality of second connectors positions the plurality of crank rods outwards of the actuation ring in the plane corresponding to the center of the axial width of the actuation ring; and a plurality of cranks with each having a third connector connected respectively to a second end of the plurality of crank rods and respectively to vanes associated with a nozzle, wherein the third connector positions the respective crank outside of the actuation ring in the plane corresponding to the center of the axial width of the actuation ring.

2. The apparatus of claim 1, wherein the cranks are connected to the vanes with a spline joint and the spline joint is centered by a bushing.

3. The apparatus of claim 1, wherein the actuation ring, the plurality of crank rods, and the plurality of cranks is a plurality of single-plane four-bar mechanisms.

4. The apparatus of claim 1, wherein the actuation ring rotates around the center of the axial width of the actuation ring in either a clockwise or counterclockwise direction based on a direction of movement associated with the actuator rod.

5. The apparatus of claim 1, wherein a second connector from the plurality of second connectors on the first end and the third connector on the second end of the plurality of crank rods are centered respectively by a plurality of bushings.

6. The apparatus of claim 1, wherein the actuator rod is connected to and positioned between two brackets extending outwards of the actuation ring from the axial width of the actuation ring.

7. The apparatus of claim 6, wherein the two brackets extending outwards of the actuation ring from the axial width of the actuation ring are symmetrical and allow the actuation rod to rotate with respect to the two brackets in the plane corresponding to the center of the axial width of the actuation ring.

8. A turbo-machine comprising:

an inlet guide vane actuation apparatus, comprising:

an actuation ring with a first connector for connecting an actuator rod, wherein the first connector positions the actuator rod outwards of the actuation ring in a plane corresponding to a center of an axial width of the actuation ring;

a plurality of crank rods with a first end connected respectively to a plurality of second connectors, wherein the plurality of second connectors positions the plurality of crank rods outwards of the actuation ring in the plane corresponding to the center of the axial width of the actuation ring; and a plurality of cranks with each having a third connector connected respectively to a second end of the plurality of crank rods and respectively to vanes associated with a nozzle, wherein the third connector positions the respective crank outside of the actuation ring in the plane corresponding to the center of the axial width of the actuation ring.

9. The apparatus of claim 8, wherein the cranks are connected to the vanes with a spline joint and the spline joint is centered by a bushing.

10. The apparatus of claim 8, wherein the actuation ring, the plurality of crank rods, and the plurality of cranks is a plurality of single-plane four-bar mechanisms.

11. The apparatus of claim 8, wherein the actuation ring rotates around the center of the axial width of the actuation ring in either a clockwise or counterclockwise direction based on a direction of movement associated with the actuator rod.

12. The apparatus of claim 8, wherein a second connector from the plurality of second connectors on the first end and the third connector on the second end of the plurality of crank rods are centered respectively by a plurality of bushings.

13. The apparatus of claim 8, wherein the actuator rod is connected to and positioned between two brackets extending outwards of the actuation ring from the axial width of the actuation ring.

14. The apparatus of claim 13, wherein the two brackets extending outwards of the actuation ring from the axial width of the actuation ring are symmetrical and allow the actuation rod to rotate with respect to the two brackets in the plane corresponding to the center of the axial width of the actuation ring.

15. A method for manufacturing an inlet guide vane system associated with turbo-machinery, the method comprising:

connecting a first end of an actuator rod to an actuation ring associated with the turbomachinery, wherein the actuator rod is located outwards of the actuation ring in a plane corresponding to a center of an axial width of the actuation ring;

connecting a first end of each of a plurality of crank rods respectively to a plurality of connectors on the actuation ring, wherein the plurality of crank rods are located outwards of the actuation ring in the plane corresponding to the center of the axial width of the actuation ring; and connecting a plurality of cranks respectively to a second end of each of the plurality of crank rods and respectively to a plurality of vanes associated with the turbomachinery, wherein the plurality of cranks are located outside of the actuation ring in the plane corresponding to the center of the axial width of the actuation ring.

16. The method of claim 15, wherein the cranks are connected to the vanes with a spline joint and the spline joint is centered by a bushing.

17. The method of claim 15, wherein the actuation ring, the plurality of crank rods, and the plurality of cranks is a plurality of single-plane four-bar mechanisms.

18. The method of claim 15, further comprising:

rotating the actuation ring around the center of the axial width of the actuation ring in either a clockwise or counterclockwise direction based on a direction of movement associated with the actuator rod.

19. The method of claim 15, wherein the actuator rod is connected to and positioned between two brackets extending outwards of the actuation ring from the axial width of the actuation ring.

20. The method of claim 19, wherein the two brackets extending outwards of the actuation ring from the axial width of the actuation ring are symmetrical and allow the actuation rod to rotate with respect to the two brackets in the plane corresponding to the center of the axial width of the actuation ring.

* * * * *